US007392747B2

(12) United States Patent
Ksyk

(10) Patent No.: US 7,392,747 B2
(45) Date of Patent: Jul. 1, 2008

(54) RAIL GUIDE FOR A SUSPENDED AND GUIDED SLIDING COMPONENT

(75) Inventor: Andreas Ksyk, Edewecht (DE)

(73) Assignee: Dorma GmbH + Co., KG, Ennepetal (DE)

( * ) Notice: Subject to any disclaimer, the term of this patent is extended or adjusted under 35 U.S.C. 154(b) by 233 days.

(21) Appl. No.: 10/557,516

(22) PCT Filed: May 18, 2004

(86) PCT No.: PCT/EP2004/005311

§ 371 (c)(1),
(2), (4) Date: Jan. 9, 2006

(87) PCT Pub. No.: WO2004/104342

PCT Pub. Date: Dec. 2, 2004

(65) Prior Publication Data

US 2007/0039512 A1 Feb. 22, 2007

(30) Foreign Application Priority Data

May 21, 2003 (DE) ..... 103 23 274

(51) Int. Cl.
*E05D 15/00* (2006.01)

(52) U.S. Cl. ..... 104/96; 104/89; 104/94; 104/130.07; 104/111; 16/95 R; 105/148; 105/155

(58) Field of Classification Search ..... 104/89, 104/93, 94, 95, 106, 107, 108, 111; 105/148, 105/150, 154, 155; 52/243.1; 16/95 R, 95 D, 16/96 R, 96 D, 87 R, 87.4 R, 94 R
See application file for complete search history.

(56) References Cited

U.S. PATENT DOCUMENTS

| | | | | |
|---|---|---|---|---|
| 4,555,828 | A * | 12/1985 | Matimura | 16/95 R |
| 5,090,171 | A * | 2/1992 | Kano et al. | 52/243.1 |
| 5,598,785 | A * | 2/1997 | Zaguroli, Jr. | 104/111 |
| 6,269,944 | B1 * | 8/2001 | Taylor | 198/860.2 |

FOREIGN PATENT DOCUMENTS

| | | |
|---|---|---|
| DE | 38 14 535 | 10/1989 |
| DE | 42 42 597 | 6/1994 |
| EP | 0 679 788 | 11/1995 |
| EP | 1 035 287 | 9/2000 |
| WO | WO 94/13915 | 6/1994 |

* cited by examiner

*Primary Examiner*—Mark T Le
(74) *Attorney, Agent, or Firm*—Cohen Pontani Lieberman & Pavane LLP

(57) ABSTRACT

A rail guide having first and second guiding rails disposed in a mirror-inverted relationship with regard to one another. At least one pair of spaced leading and following carriages are displaceably mounted to the guiding rails so as to engage and transport a sliding component along a transport path towards a stacking area. While the leading and following carriages are slidably supported by both guiding rails along the main track of the transport path, the leading carnage slides along the first rail, and the trailing carriage slides along the second rail along the transport path downstream from the main track in the stacking area.

6 Claims, 3 Drawing Sheets

RAIL GUIDE FOR A SUSPENDED AND GUIDED SLIDING COMPONENT

PRIORITY CLAIM

This is a U.S. national stage of application No. PCT/EP2004/005311, filed on 18 May 2004. Priority under 35 U.S.C. §119(a) and 35 U.S.C. §365(b) is claimed from German Application No. 103 23 274.5, filed 21 May 2003.

BACKGROUND OF THE INVENTION

1. Field of the Invention

The invention relates to a rail guide for a suspended and guided sliding component.

2. Description of the Related Art

The sliding components guided in the aforementioned rail guide may be executed differently, for example as wood panels or glass panels, in simple or double disposition. In the extended disposition, the sliding components form a closed wail and they can be displaced by guiding them in the rail guide into a stacking area, normally in a side-by-side disposition. Generally, two carriages are assigned to each sliding component. Provided that the spaced apart carriages supporting a sliding component are guided at a single guiding rail only, one turnout is required for conveyance into a stacking area, which diverts respectively one of the spaced apart carriages towards the guiding rail leading into the stacking area. However, in the case of a rail guide being formed by two adjacent guiding rails disposed side-by-side, one of the spaced apart carriages is guided in one guiding rail and the other one is guided in the adjacent guiding rail. In this case, one of the two adjacent guiding rails forms the branch leading into the stacking area. The invention relates to this type of device.

The document DE 42 42 597 A1 discloses a device of this species. Each of two carriages for displacing a sliding component is guided by one carrying roller and one guiding roller displaceable along a single one of the first and second adjacent guiding rails. In the aforementioned known device, a branching into a stacking position is only possible by utilizing an additional expensive turnout. According to the present invention, the device of this species thus uses two guiding rails which are disposed mirror-inverted with regard to one another; however, guidance of the carriages in the adjacent guiding rails is different from the subject matter of the application in that the characteristics described in the inventive object cannot be realized with the state-of-the-art according to DE 42 42 597 A1.

The document DE 38 14 535 C2 describes a roller device for a suspended sliding wall, wherein a one-piece guiding rail has a symmetrical structure relative to a vertical central longitudinal axis of the rail's cross section. In this case, one of the two carriages assigned to one sliding component is positively guided by means of carrying rollers and guiding rollers in the right region of the guiding rail and the other one in the left region. The device allows for branching—as intended with the present invention—without involving a turnout; however, due to the required division of the guiding rail, a special section has to be provided in the branching region. The known device is particularly disadvantageous in that each carriage, in the region of the main track, is only supported either in the left region or in the right region of the guiding rail, that is to say, only half of the provided profile is used by the respective carriage.

From the document EP 0 679 788 B1 is known a drive mechanism for the suspension of a door wherein the tilting moment considered to be disadvantageous, with a lateral suspension of the door, should be avoided by centrally supporting the carrying rollers of a carriage in the guiding rail, which laterally engage with the guiding rail, the guiding rollers sitting close to the guiding rail on the exterior side thereof. In this case, two of the above described guiding rails are provided at a trunnion, which is suspended at a sub-construction, such that, in relation to a door, two spaced-apart carriages are guided in respectively one of the adjacent guiding rails. A branching is obviously not intended, and likewise could not be realized because of the trunnion that is common to the guiding rails. Moreover, the known structure requires an extraordinary construction width and increased technical expense.

SUMMARY OF THE INVENTION

It is an object of the invention to provide a rail guide in which the rail itself is improved, particularly in relation to the manufacturing process, wherein the rail profile and the corresponding embodiment of the carriage in a branching region of a stacking area, allows for abandoning a turnout without modifying the profile. Furthermore, substantially over the displacement path of the sliding component, that is to say over the so-called main track, the complete profile of the rail guide should possibly be used by the carriage. Finally, a particular embodiment of the guiding rails should guarantee a smooth transition from one rail section to an adjoining rail section.

According to the invention, two profiles of a guiding rail are used, which are inexpensive in manufacturing and shaping, and can be joined to form a smooth rail guide, whereby the assignment and embodiment of the carriages allows for the support of the carriages at the entire rail guide over the main track and the branching can be realized without needing a turnout.

As mentioned above, with a mirror-inverted embodiment of the guiding rails, the guiding rollers assigned to one carriage are formed with different heights. As a consequence, the higher formed guiding roller is subject to positive guidance on both sides and, for example in a branch region, it must thus follow the assigned guiding rail. However the adjacent lower guiding roller is able to leave the assigned guiding rail. Therefore, while travelling on the main track, the lower formed guiding roller has a lateral guiding function only in the region of the contact at the vertical strut of the guiding rail. It should be understood that for the deviation into the branch region of a stacking area, the guiding rollers of the respective advancing and following carriages have to be disposed offset correspondingly.

In order to guarantee the above described guiding function, it has proven to be advantageous that a flange, oriented against the carriage, is positioned at the free end of the upper horizontal leg of the guiding rail. The flange practically guarantees the positive guidance on both sides of the higher formed guiding roller.

As is known per se from DE 38 15 535 C2, the upper horizontal leg of the guiding rail, at the surface thereof oriented against a sub-construction, presents an undercut groove for the accommodation of attachment screws. According to a specification of the inventive solution, the sub-construction is formed such that it presents a web-like suspended plate, whereby a hook-like projection of a bracket, for covering a ceiling cover, engages with the groove extending between the adjacent suspended plates. Thus, the groove fulfils two functions, on the one hand, it serves as an attachment for the guiding rails at the sub-construction and, on the other hand, it serves as the attachment for the covering of a ceiling cover.

BRIEF DESCRIPTION OF THE DRAWINGS

The invention will now be explained in more detail, reference being made to one embodiment example, in which.

DETAILED DESCRIPTION OF THE PRESENTLY PREFERRED EMBODIMENTS

Figure 1:
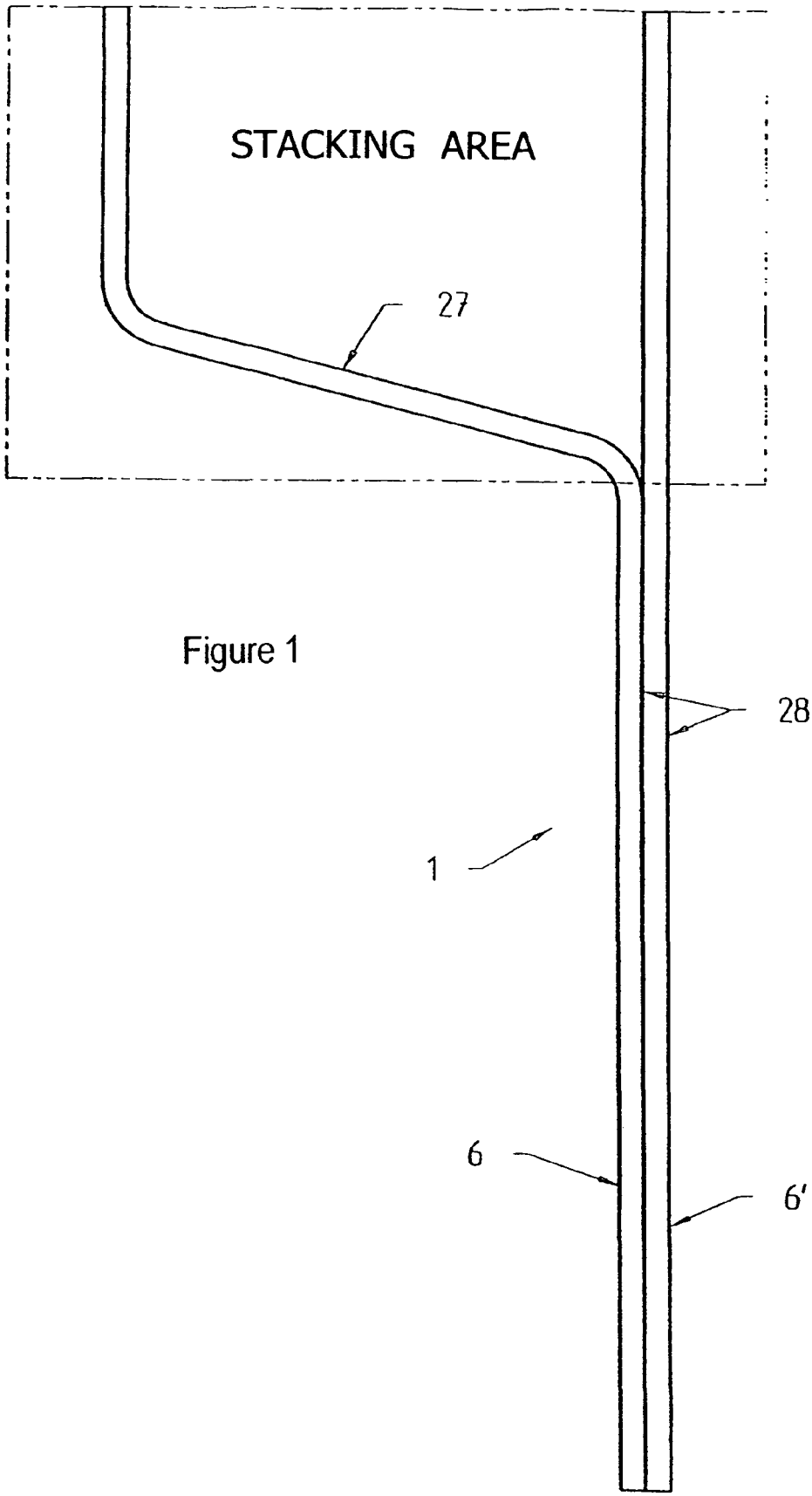
FIG. 1 shows a diagrammatical plan view on a rail guide.

FIG. 1 shows a rail guide 1 which, in the region of a main track, consists of guiding rails 6 and 6' joined to form a line of rails 28. In this case the guiding rail 6 is formed with a branch 27 leading into a stacking area.

Figure 2:
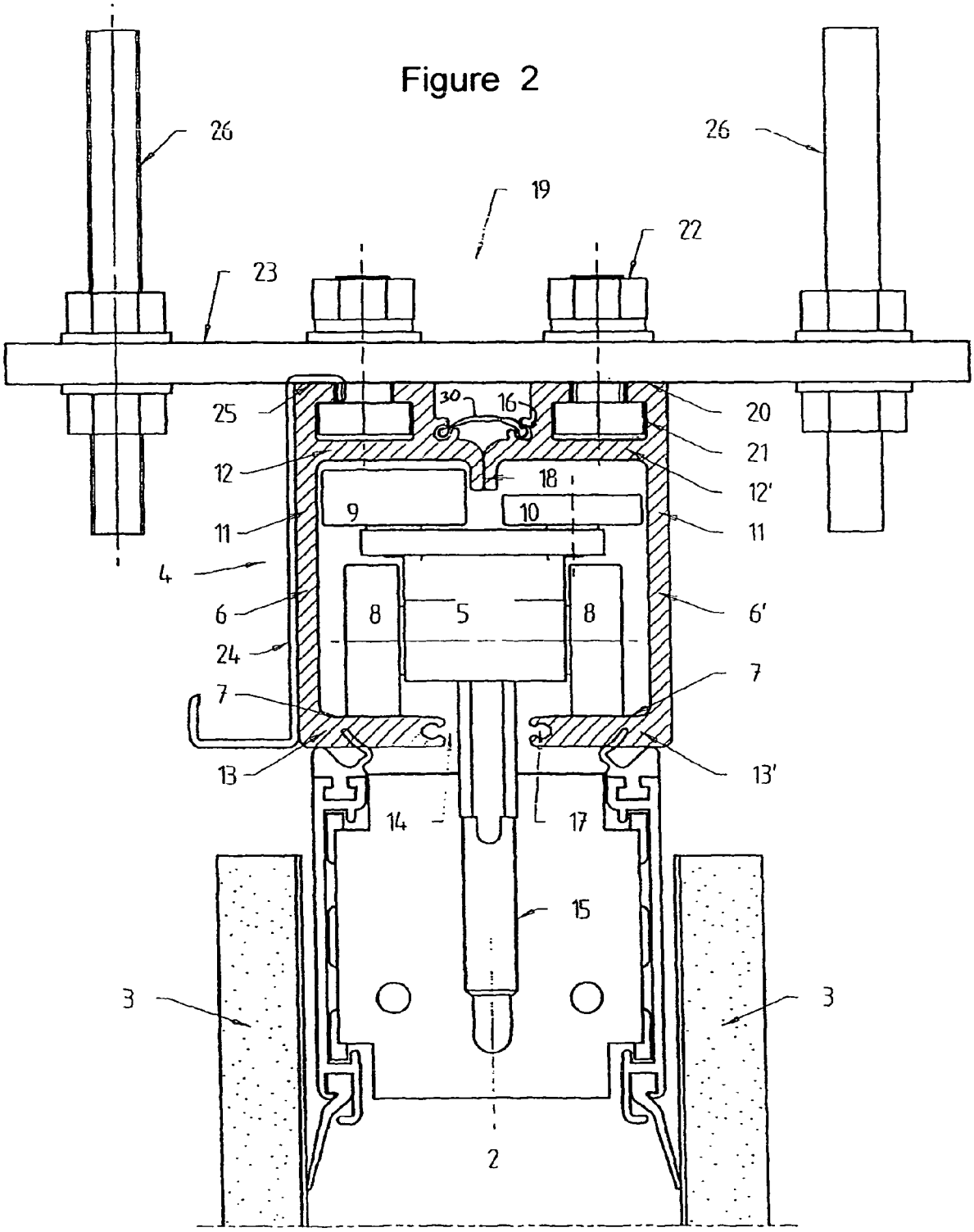
FIG. 2 shows a cross section through the rail guide with an assigned carriage.
Figure 3:
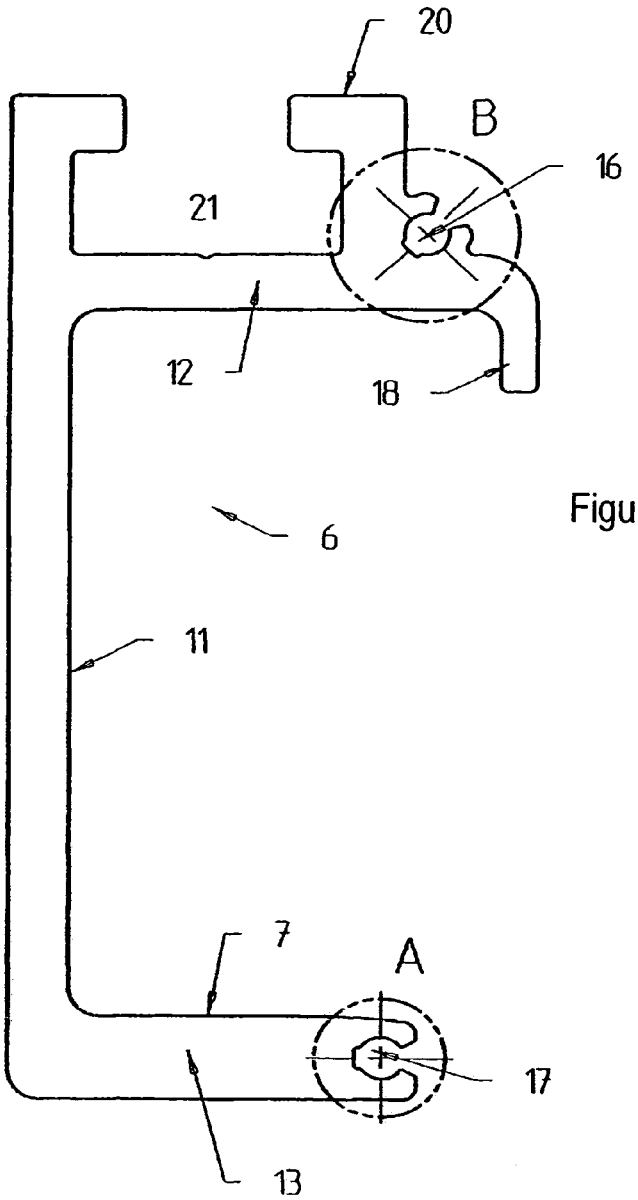
FIG. 3 shows in an enlarged illustration compared to FIG. 2 the cross section of a guiding rail.
Figure 4:
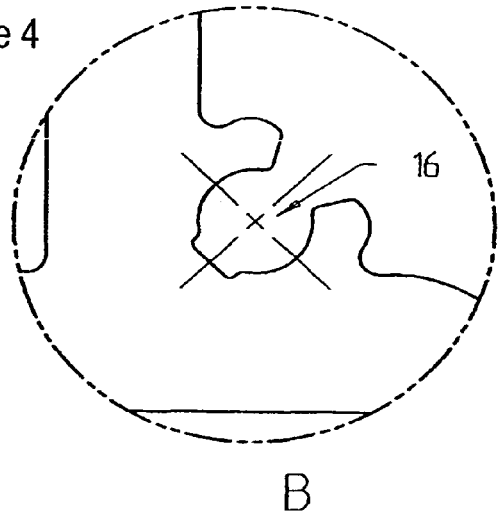
FIGS. 4 and 5 show the detailed illustrations B and A according to FIG. 3.
Figure 5:
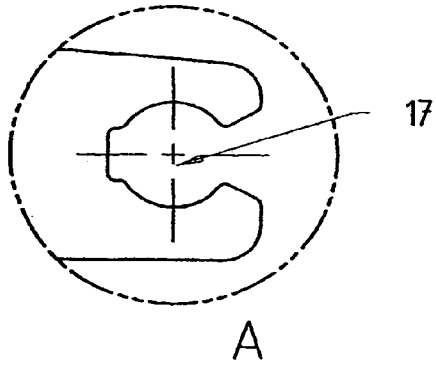

According to the cross sectional illustration of FIG. 2, a sliding component 2, presenting two panels 3 in this embodiment example, is suspended from a carriage 5 via a suspension bolt 15. The separate guiding rails 6 and 6', which have identical profiles and are disposed mirror-inverted with regard to one another, each includes a vertically extending strut 11, upper legs 12 and 12' disposed facing each another, as well as lower legs 13 and 13' disposed facing each another, between which a longitudinal slot 14 is left for the passage of the suspension bolt 15. A running mechanism 4, including support rollers 8 rolling on running paths 7 of the lower horizontal legs 13 and 13' as well as guiding rollers 9 and 10, is assigned to the carriage 5. In relation to the guiding roller 10, the guiding roller 9 is executed higher and, due to the positive guidance (see FIG. 1), when entering the stacking area, will thus follow a flange 18 of the upper horizontal leg 12 oriented against the carriage 5. In this case during the branching action, the lower guiding roller 10 is able to run below the above mentioned flange 18 without even contacting it. As can be seen in FIG. 2, as well as particularly in FIGS. 3 to 5, both in the region of the upper horizontal legs 12 and 12' and in the region of the lower horizontal legs 13 and 13', aligned recesses 16 respectively 17 are provided, into which centering elements (not illustrated) can be inserted, guaranteeing an accurate alignment of the butt joints of adjoining guiding rails 6, respectively 6'.

The guiding rails 6 and 6' are attached at a sub-construction having the reference numeral 19, a surface 20 of the upper horizontal legs 12 and 12', which is oriented towards the sub-construction and sits close to a suspended plate 23, which is web-like formed. An undercut groove 21 is assigned to each of the horizontal legs 12 and 12' in this case, with which attachment screws 22 engage. At the same time, the undercut groove 21 serves for the attachment of a bracket 24 for covering a ceiling cover (not illustrated), which engages with a hook-like projection 25 the undercut groove 21. The entire sub-construction 19 may be attached at a ceiling construction (not illustrated), for example by means of threaded rods 26.

What is claimed is:

1. A rail guide apparatus for suspending and guiding a sliding component, the apparatus comprising:

a rail guide comprising side-by-side first and second guiding rails, each said guiding rail comprising a vertical strut, an upper horizontal leg extending from the vertical strut toward the upper horizontal leg of the other guiding rail and ending at a downward extending flange, and a lower horizontal leg extending from the vertical strut toward the lower horizontal leg of the other guiding rail; and a leading carriage and a following carriage coupled to said sliding component, each carriage being coupled to said sliding component by a shaft extending vertically between said lower horizontal legs, each carriage having a pair of support rollers rotatable about a horizontal axis and supported on respective said lower horizontal legs, and a pair of side-by-side first and second guide rollers rotatable about respective vertical axes and running between said vertical struts, wherein the first guide roller of the leading carriage extends higher than the second guide roller of the leading carriage, the first guide roller of the leading carriage being guided by both the vertical strut of the first guide rail and the flange of the first guide rail, the second guide roller of the leading carriage being guided only by the vertical strut of the second guide rail, wherein the second guide roller of the following carriage extends higher than the first guide roller of the following carriage, the second guide roller of the following carriage being guided by both the vertical strut of the second guide rail and the flange of the second guide rail, the first guide roller of the following carriage being guided only by the vertical strut of the first guide rail, whereby, where the first and second guiding rails are disposed so that respective said flanges form a butt joint, the carriages will move in the same direction, and where the first and second guiding rails diverge, the leading carriage will follow the first guiding rail and the following carriage will follow the second guiding rail.

2. The rail guide apparatus of claim 1 wherein the first and second guiding rails have identical profiles and are arranged in a mirror-symmetric relationship.

3. The rail guide apparatus of claim 1 wherein each said guiding rail comprises a recess for receiving a centering element between the rails, whereby the flanges can be aligned to form a butt joint.

4. The rail guide apparatus of claim 1 wherein the lower horizontal legs are spaced apart to form a slot where the first and second guiding rails are disposed so that respective said flanges form a butt joint.

5. The guide apparatus of claim 1 wherein each said upper horizontal leg is formed with an undercut groove for attaching the rail to a sub-construction.

6. The guide apparatus of claim 5 further comprising a bracket having a hook-like projection which engages the undercut groove of one of said rails.

* * * * *